United States Patent [19]

Mackal

[11] Patent Number: 5,029,367

[45] Date of Patent: Jul. 9, 1991

[54] PROTECTIVE COVER AND PULLED LANYARD INDICATOR FOR AN INFLATOR

[76] Inventor: Glenn H. Mackal, 4923 59th Ave. S., St. Petersburg, Fla. 33715

[21] Appl. No.: 522,621

[22] Filed: May 14, 1990

[51] Int. Cl.[5] ..... B63C 9/16; F16G 11/00

[52] U.S. Cl. ..... 24/115 F; 441/108

[58] Field of Search ..... 24/115 F; 441/92, 106, 441/108; 405/186; 224/30 R

[56] References Cited

U.S. PATENT DOCUMENTS

| | | | |
|---|---|---|---|
| 1,637,003 | 7/1927 | Lang | 24/115 F |
| 1,786,314 | 12/1930 | Passmel | 24/115 F |
| 4,445,253 | 5/1984 | Howey | 24/115 F |
| 4,489,855 | 12/1984 | Boetger | 224/30 R |
| 4,720,281 | 1/1988 | Matsuoka | 441/108 |
| 4,842,562 | 6/1989 | Supal | 441/108 |

*Primary Examiner*—Victor N. Sakran

*Attorney, Agent, or Firm*—Joseph C. Mason, Jr.; Ronald E. Smith

[57] ABSTRACT

A removable clip that engages an inflator. The clip prevents inadvertent piercing of a gas cartridge secured to the inflator and indicates whether or not the inflator has been used. The clip is carried on the lanyard that is pulled to activate the inflator and includes a pair of laterally extending arms having detents formed on their respective free ends that engage opposite ends of a bore formed in the inflator. The detents retain the clip in place until the lanyard is pulled, and the clip remains on the lanyard after the lanyard has been pulled so that the clip is not lost.

2 Claims, 1 Drawing Sheet

PROTECTIVE COVER AND PULLED LANYARD INDICATOR FOR AN INFLATOR

TECHNICAL FIELD

This invention relates, generally, to inflators of the type used with gas cartridges. More particularly, it relates to a clip that is releasably securable to an inflator to prevent inadvertent puncturing of the gas cartridge therein.

BACKGROUND ART

Inflators are typically provided with a "D"-shaped keyway formed therein to slidably receive a complementally formed inflation manifold that projects perpendicularly from the exterior surface of an inflatable article. Typically, the distal free end of the manifold is externally threaded and a nut engages said free end to secure the manifold to the inflator.

A gas cartridge is typically screw threadedly engaged with an inflator in such a way that visual inspection of the inflator and cartridge secured thereto does not reveal whether or not the cartridge has been used. More particularly, the puncturable end of the cartridge cannot be visually inspected without unscrewing the cartridge from the inflator. When an inflatable article such as a life vest or raft is needed quickly, ample time may not be available to perform an inspection of the cartridge, especially if one must select a vest or raft from a stack of the same, some of which may contain spent cartridges.

Inadvertent puncturing of the gas cartridge can also occur, because inflators are intentionally designed for ease of puncturing. Thus, a light tug on a lanyard causes a bell crank to pivot about a pivot shaft and to thereby drive a piercing pin into the cartridge. Accordingly, there is a need to provide a protective cover for a typical inflator that guards against inadvertent release of gas from a cartridge secured thereto. Perhaps even more importantly, there is a need for an indicator that will visually indicate whether or not a lanyard has been pulled.

The art has developed a clip that releasably engages the inflator and which overlies the bell crank to thereby provide some resistance to unintentional rotation of the bell crank. The clip adequately performs its intended function, but once the clip has been disengaged from the inflator by a strong pull on the lanyard, the clip is simply ejected and lost. Thus, there is a need for a clip that is not lost after use and which will indicate whether or not a lanyard has been pulled.

DISCLOSURE OF INVENTION

A protective cover and pulled lanyard indicator for an inflator are provided in the form of a clip that is carried by the lanyard and that releasably engages an inflator; when the lanyard is pulled, the clip is separated from the inflator and the gas cartridge is punctured in the well known manner. Since the clip is carried by the lanyard, it will remain thereon even after the lanyard has been pulled, thereby indicating that the lanyard has been pulled. Before the lanyard is pulled, the clip protects against inadvertent piercing of the cartridge.

It is therefore understood that a general object of this invention is to advance the art of inflators.

A more specific object is to provide an improved inflator having means that protects it against inadvertent activation.

Another object is to provide an indicator means associated with an inflator that visually indicates whether or not the lanyard has been pulled.

Still another object is to provide a clip that is not lost when the lanyard is pulled.

These and other objects and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figures 1, 2, 3, 4, 5, 6:
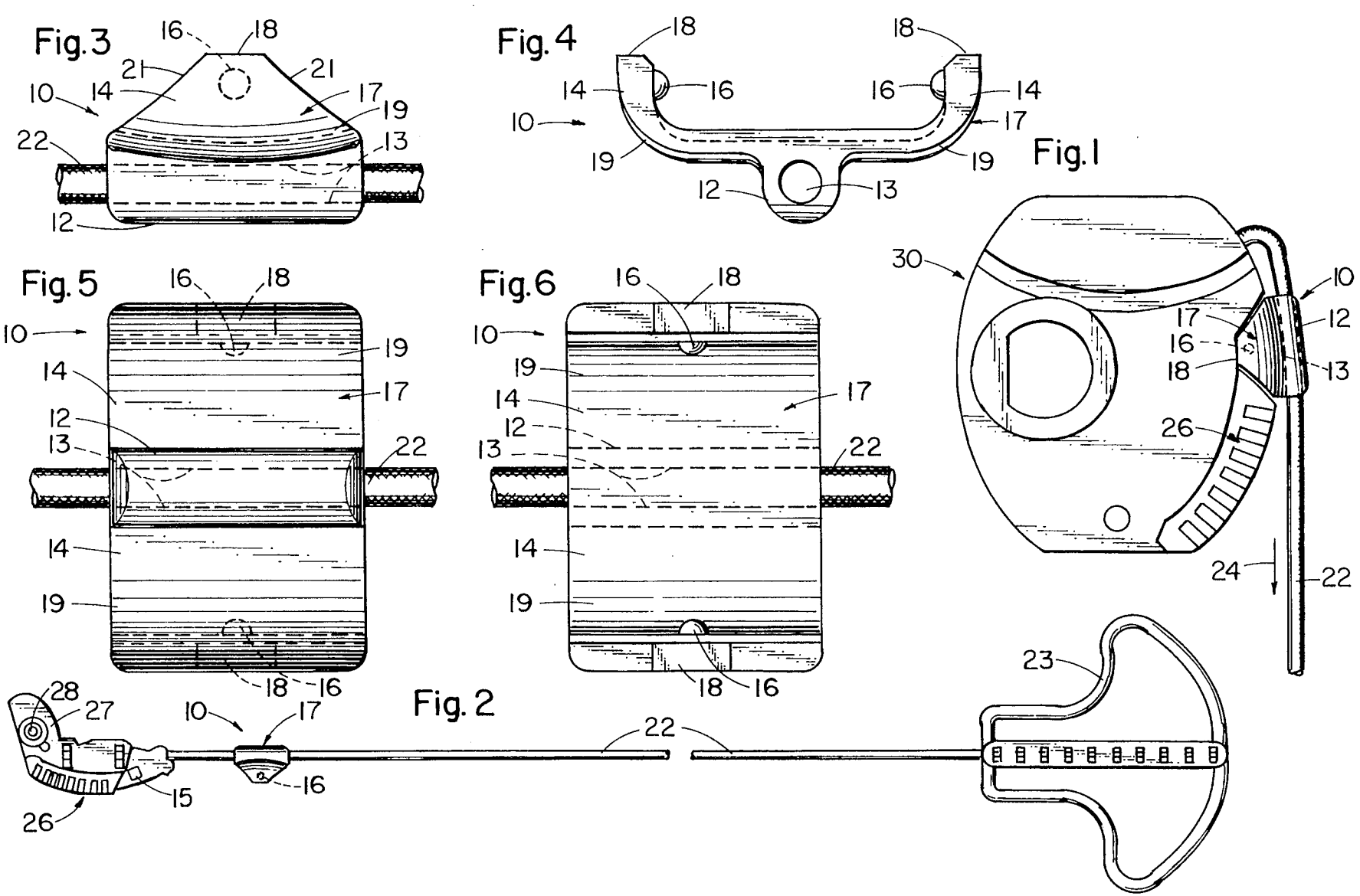
FIG. 1 is a front elevational view of an inflator equipped with the novel clip.
FIG. 2 shows the positioning of the clip on the lanyard after the handle activating the inflator has been pulled.
FIG. 3 is a side elevational view of the clip.
FIG. 4 is an end elevational view thereof.
FIG. 5 is a top plan view thereof.
FIG. 6 is a bottom plan view thereof.

The novel protective clip is denoted as a whole by the reference numeral 10 in FIG. 1; it is shown in its operable engagement to an inflator 30 of the well known type.

Inflator 30 includes a "D"-shaped keyway 32 for slidably receiving an inflation manifold, not shown, having a matching transverse section for keyed engagement therewith. When lanyard 22 (FIG. 1) is pulled in the direction indicated by directional arrow 24 (by pulling handle 23, shown in FIG. 2), bell crank 26 of the inflator 30 rotates about pivot shaft 28, and a part 27 (FIG. 2) thereof cammingly engages a cartridge piercing pin and drives it into the cartridge. Gases escaping therefrom are channeled to a radially extending bore formed in the manifold secured in keyway 32 and the article is thus inflated.

This just-described general operation of inflator 30 is well known. However, the assembly of parts shown in FIG. 2 was heretofore unknown; more specifically, lanyard 22 is shown with its opposite ends molded into bell crank 26 and handle 23 so that a single, monolithic or integral unit is formed. The novel method of making this integral structure is shown in a copending disclosure by the same inventor entitled "Apparatus and Method for Making Inflator Parts."

The novel addition to inflator 30 is a clip denoted 12 in FIGS. 1 and the other Figs. In FIG. 1 it will be observed that clip 10 is permanently carried by lanyard 22; more particularly, clip 10 includes a longitudinally extending integral boss 12 having a coextensive bore 13 formed therein that slidably but tightly receives lanyard 22.

It should also be noted that clip 12 has a main body part, denoted 17 as a whole, that has a frusto sector shape. Body 17 of clip 10 includes a pair of laterally extending arms 14, 14, best shown in FIGS. 5 and 6, that extend in opposite directions relative to boss 12, as perhaps best depicted in FIGS. 4–6. Each arm 14 is coextensive with boss 12, and a gradual ninety degree bend is formed therein as at 19 in FIG. 4; the respective upturned distal ends of each arm 14 include radial edges 21 (FIG. 3) that terminate in flat 18.

Inwardly extending protuberances or detents 16 are formed on each arm 14; they releasably engage opposite ends of a bore 15 (FIG. 2) that extends through inflator 30.

The operation of clip 10 should now be understood. When positioned as shown in FIG. 1, it protects the cartridge (not shown) against inadvertent piercing by preventing inadvertent pulling of lanyard 22. It performs the function because detents 16, 16 firmly grip the opposite ends of bore 16 to thereby provide an initial resistance to lanyard movement. Just as importantly, after lanyard 22 has been pulled, as indicated in FIG. 2, clip 10 disengages from its seated position as shown in FIG. 1 and assumes the position depicted in FIG. 2, thereby indicating that the lanyard has been pulled. Significantly, the clip is never lost and it can be re-used when a new cartridge is inserted into the inflator.

Clip 12 was heretofore unknown, anywhere in the world, i.e., lanyard-carried clips do not appear if the prior art. Accordingly, this invention is new and useful. Moreover, it was not obvious to those of ordinary skill in this art at the time it was made, in view of the prior art, considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A clip for preventing inadvertent activation of an inflator, comprising:

first and second arm members adapted to releasably engage opposite sides of an inflator;

means permanently securing said clip to a lanyard so that the clip remains attached to its lanyard even after the lanyard has been pulled;

said means including an elongate boss member and a bore means formed in said boss member for snugly receiving said lanyard therein.

2. An inflator safety clip, comprising:

a centrally bored, longitudinally extending boss member for snugly receiving a lanyard therein;

first and second laterally extending arm members integral to said boss member, said first and second arm members having a common longitudinal extent with said boss member and said first and second arm members extending in diametrically opposite directions relative to said boss member;

first and second gripping members being formed at distal free ends of said first and second arm members, respectively, said first and second gripping members being bent about ninety degrees relative to a common plane occupied by said first and second arm members and said first and second gripping members extending in a common direction away from said boss member;

first and second detent members integral to said first and second gripping members, respectively, said detent members extending laterally inwardly toward one another;

whereby said detent members releasably engage opposite ends of a bore formed in an inflator so that said clip prevents inadvertent inflation of an inflatable article attached to said inflator and so that pulling on said lanyard disengages said clip from said inflator to indicate that said lanyard has been pulled; and whereby said clip remains positioned on said lanyard even after said lanyard has been pulled.

* * * * *